US006106381A

United States Patent [19]

Leder et al.

[11] Patent Number: 6,106,381

[45] Date of Patent: Aug. 22, 2000

[54] GRINDING DEVICE FOR SHARPENING THE CLOTHING OF A CARDING CYLINDER

[75] Inventors: Armin Leder; Markus Schmitz, both of Mönchengladbach, Germany

[73] Assignee: Trützschler GmbH & Co. KG, Mönchengladbach, Germany

[21] Appl. No.: 09/209,442

[22] Filed: Dec. 11, 1998

[30] Foreign Application Priority Data

Dec. 13, 1997 [DE] Germany ..... 197 55 553
Oct. 14, 1998 [DE] Germany ..... 198 47 236

[51] Int. Cl.[7] ..... B24B 19/00

[52] U.S. Cl. ..... 451/416; 451/21; 451/56; 451/443; 451/445

[58] Field of Search ..... 451/21, 56, 443, 451/444

[56] References Cited

U.S. PATENT DOCUMENTS 3,881,281 5/1975 Hollingsworth ..... 451/28
4,984,395 1/1991 Demuth ..... 451/49

FOREIGN PATENT DOCUMENTS 0 322 637 7/1989 European Pat. Off. .
0 565 486 10/1993 European Pat. Off. .
0 800 895 10/1997 European Pat. Off. .
196 05 635 8/1997 Germany .

*Primary Examiner*—David A. Scherbel
*Assistant Examiner*—Shantese McDonald
*Attorney, Agent, or Firm*—Venable; Gabor J. Kelemen

[57] ABSTRACT

A carding machine includes a main carding cylinder having a circumferential surface carrying a cylinder clothing thereon; and a cooperating with the main carding cylinder. The traveling flats assembly includes a plurality of clothed flat bars arranged in a series and a flat drive for moving the clothed flat bars in an endless path having a working path portion along which the flat bar clothings cooperate with the cylinder clothing and a return path portion; and a grinding assembly for sharpening the cylinder clothing. The grinding assembly includes a grinding flat bar adapted to be positioned in the series of clothed flat bars to be moved by the flat drive in unison with the clothed flat bars; and a grinding element mounted on the grinding flat bar. The grinding element is in a contacting relationship with the cylinder clothing along the working path portion of the traveling flats assembly.

12 Claims, 6 Drawing Sheets

CM
A
B
C
D
M
1
2
3a
3b
3c
4
4a
5
6
7
8
9
10
11
12
13
14
15
16
17
24
25

GRINDING DEVICE FOR SHARPENING THE CLOTHING OF A CARDING CYLINDER

CROSS REFERENCE TO RELATED APPLICATION

This application claims the priority of German Application Nos. 197 55 553.5 filed Dec. 13, 1997 and 198 47 236.6 filed Oct. 14, 1998, which are incorporated herein by reference.

BACKGROUND OF THE INVENTION

This invention relates to a grinding device for sharpening the clothing of the main carding cylinder of a carding machine. The grinding device which may be temporarily mounted on the carding machine, has a holder which carries a grinding element such as a grinding wheel or a grindstone and is, according to the prior art, affixed to the carding machine when a sharpening of the cylinder clothing is required.

Published European Application 041 186 discloses a grinding device for sharpening the clothing of, for example, the main carding cylinder of a carding machine. The grinding device which represents the conventional practice, includes a rotating grinding roll which extends along the axial length of the main carding cylinder. It is a disadvantage of such a conventional arrangement that it needs a substantial technological outlay for its operation and preparatory work. Thus, to permit the use of the conventional grinding device the following measures have to be taken: stopping the fiber feed and causing the traveling flats and the main carding cylinder to run idle (that is, without fiber material). Then the carding machine is stopped, the cylinder clothing is exposed, and the cylinder cover portion in the service region of the grinding device is removed. Then the mount for the grinding device is installed, the grinding device is inserted and secured such that it is set parallel to the carding cylinder, the current connection to the grinding device is established, and the protective plates for safely guarding the open cylinder zone are set in place. After all these steps the grinding operation may start. In order to be able to again operate the carding machine, that is, upon completion of the grinding process, the above-listed measures have to be performed in the reverse order. The labor time involved for the entire procedure—assuming the presence of a cylinder braking device—is more than 1.5 hours.

It is known to install permanently a grinding system in each carding machine and therefore such grinding system is in a standby condition, ready to operate. The costs, however, for such a solution are considered to be prohibitive. In addition, the cylinder clothing needs to be ground only from time to time so that the permanently installed grinding device is idle most of the time.

SUMMARY OF THE INVENTION

It is an object of the invention to provide an improved grinding device of the above-outlined type from which the discussed disadvantages are eliminated and which, in particular, is of simple structure and makes possible a significant reduction of the time needed for preparing the grinding process.

This object and others to become apparent as the specification progresses, are accomplished by the invention, according to which, briefly stated, the carding machine which incorporates the invention includes a main carding cylinder having a circumferential surface carrying a cylinder clothing thereon; and a traveling flats assembly cooperating with the main carding cylinder. The traveling flats assembly includes a plurality of clothed flat bars arranged in a series and a flat drive for moving the clothed flat bars in an endless path having a working path portion along which the flat bar clothings cooperate the cylinder clothing and a return path portion; and a grinding assembly for sharpening the cylinder clothing. There is further provided a grinding assembly which includes a grinding flat bar adapted to be positioned in the series of the clothed flat bars to be moved by the flat drive in unison with the clothed flat bars. A grinding element, which is mounted on the grinding flat bar, is in a contacting relationship with the cylinder clothing along the working path portion of the traveling flat assembly.

By mounting the grinding element on a support structure which substantially corresponds to the configuration of a clothed flat bar of the travelling flats assembly and by providing that such grinding flat bar may co-travel with the regular clothed flat bars, the complexity of the grinding device and the time needed for preparing the grinding process are significantly reduced. Thus, in a simple manner, by replacing a regular, clothed flat bar (which cooperates with the cylinder clothing) with a flat bar which, according to the invention, is provided with a grinding element, the installation and the removal of the grinding device may be rapidly performed. It is a particular advantage of the invention that the grinding flat bar may be installed or removed on the exposed, free side of the travelling flats assembly as the flat bars perform their return travel. Such an operation which takes only a few seconds, involves the simple insertion or removal of the flat bar.

The invention has the following additional advantageous features:

- The flat bar carrying a grinding element may be installed on or removed from the travelling flats during operation thereof.
- On each side of the carding machine the flat bar ends are in engagement with an endless belt and the securement of the belt with the flat bar ends is effected without additional securing elements.
- The connection between belt and flat bar ends may be released during operation.
- The flat bars, on their side oriented away from the sliding guides, lie loosely on the outer face of the drive belt along the return travel path.
- The grinding element is biased towards the cylinder clothing, for example, by a spring, by gravity or by the tension of the belt of the traveling flats.
- The grinding element extends along the axial length of the carding cylinder.
- The grinding element extends transversely to the cylinder axis.
- For moving the grinding element, a drive motor is provided which is connected to a control device, a regulating device or a switching device.

DESCRIPTION OF THE PREFERRED EMBODIMENTS

Figure 1:
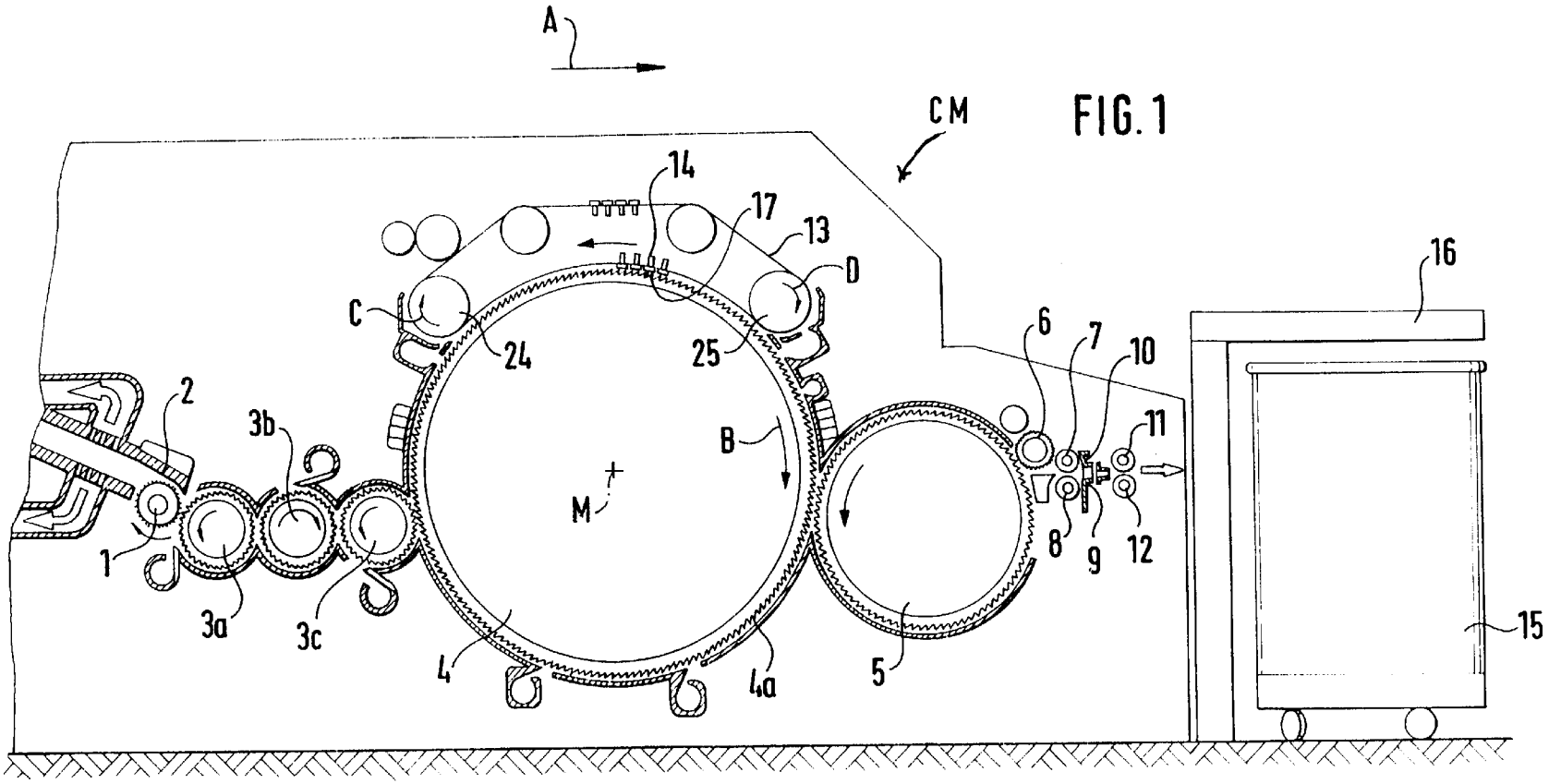
FIG. 1 is a schematic side elevational view of a carding machine incorporating the invention.

FIG. 1 shows a carding machine CM which may be an EXACTACARD DK 803 Model manufactured by Tr ützschler GmbH & Co. KG, Mönchngladbach, Germany. The carding machine CM has a feed roll 1 cooperating with a feed table 2, licker-ins 3*a*, 3*b* and 3*c*, a main carding cylinder 4 having a clothing 4*a*, a doffer 5, a stripping roll 6, crushing rolls 7 and 8, a web guiding element 9, a sliver trumpet 10, calender rolls 11 and 12, a traveling flats assembly 13 which includes clothed flat bars 14, a coiler can 15 and a sliver coiling device 16. The direction of rotation and travel of the respective components are indicated by curved arrows. The grinding device according to the invention is designated at 17.

Figure 2:
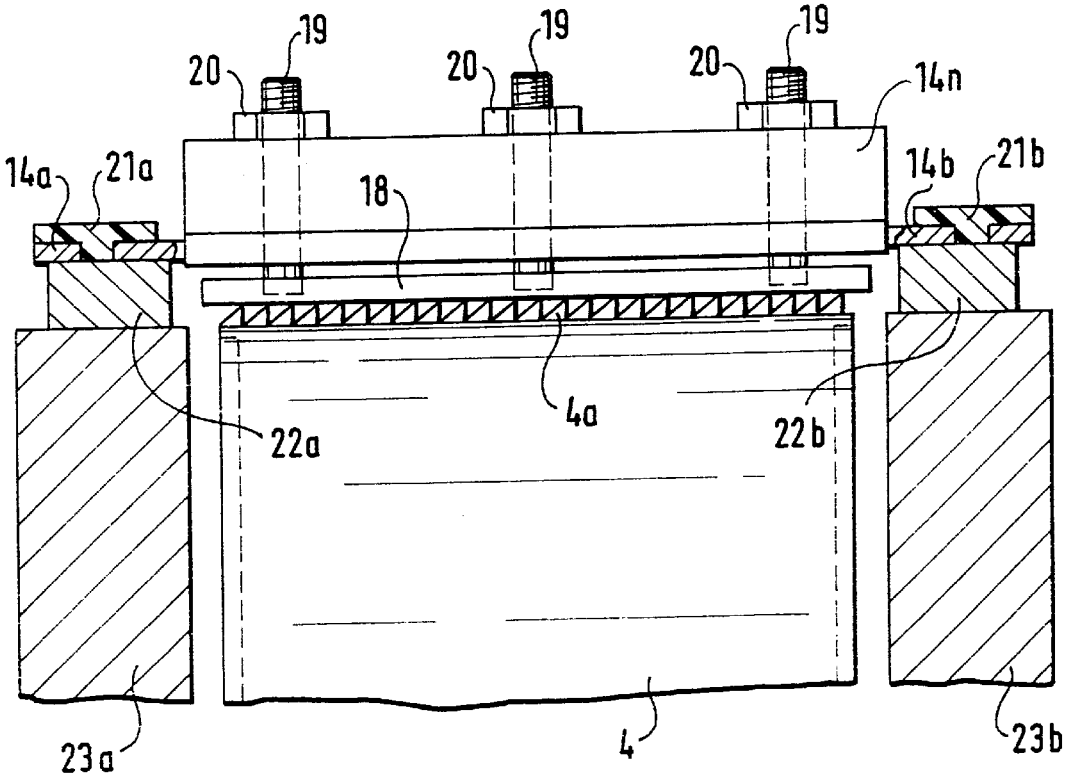
FIG. 2 is a schematic end elevational view of a preferred embodiment of the invention shown installed in the travelling flats assembly and depicted during grinding operation.

Turning to FIG. 2, a grindstone 18 which is attached by means of bolts 19 and nuts 20 to the underside of a flat bar 14*n* along the entire length thereof, has a lower surface which is in operative engagement with the carding cylinder clothing 4*a*. The flat bar 14*n* has opposite flat bar ends 14*a* and 14*b* which are in engagement with respective toothed belts 21*a* and 21*b* that drag the flat bar 14*n* over respective flexible bends 22*a* and 22*b*, together with the normal, clothed flat bars 14, as shown in FIG. 1.

Figure 3A:
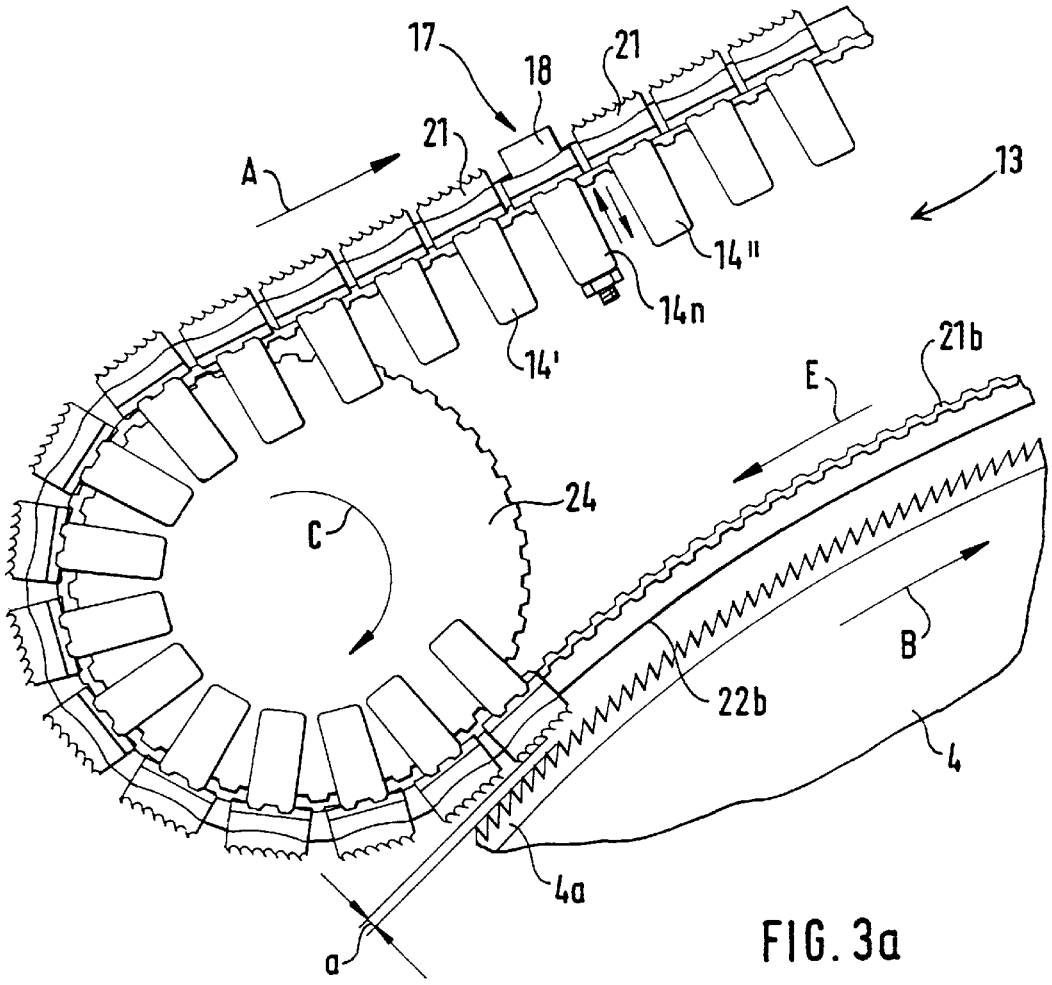
FIG. 3*a* is a fragmentary schematic side elevational view of an end portion of travelling flats assembly carrying a grinding device according to the invention.
Figure 3B:
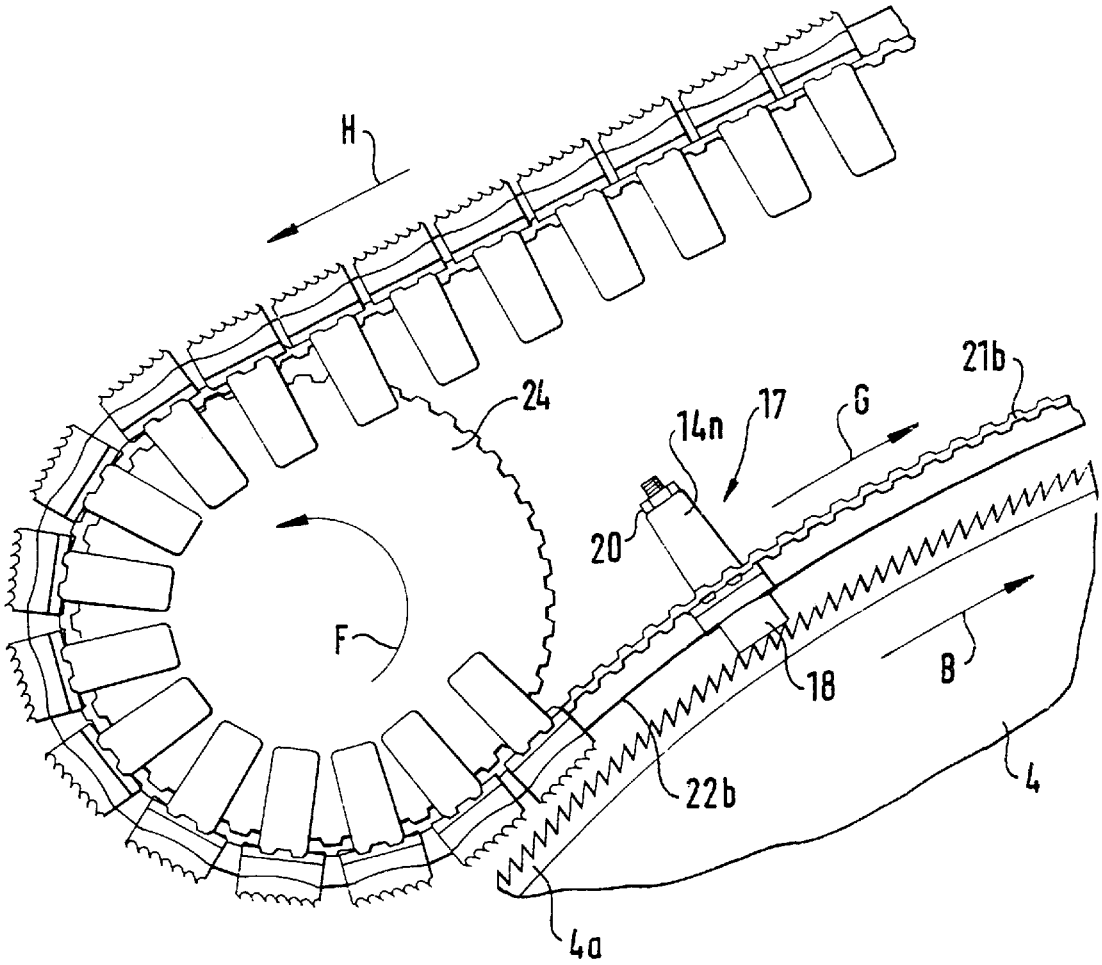
FIG. 3*b* is a view similar to FIG. 3*a* showing motions of directions different from that in FIG. 3*a*.

FIGS. 3*a* and 3*b* show the arrangement of the flat bar 14*n* carrying the grindstone 18 and being situated between flat bars 14' and 14" which are provided with the usual flats clothing 21 situated at a predetermined distance from the cylinder clothing 4*a*. By means of a precision thread 20 at a rearward end of the bolt 19, the position of the grinding surface of the grindstone 18 with respect to the cylinder clothing 4*a* may be set. While in FIG. 3*a* the dual toothed belt 21 travels in the direction E opposite the travel direction B of the carding cylinder and the front sprocket 24 rotates clockwise in the direction C, according to FIG. 3*b* the traveling flats 13 move, in the operational zone, codirectionally with the carding cylinder 4 in the direction G and thus the front sprocket 24 rotates counterclockwise in the direction of the arrow F.

In FIG. 3*a* the grinding element 17 formed of the flat bar 14*n* and the grindstone 18, is situated on the return portion of the traveling flats assembly 13, that is, on that side which is remote from the cylinder clothing 4*a*. In that position, the grinding element 17 may be inserted into the travelling flats 13 or removed therefrom in a simple and rapid manner. As seen in FIG. 2, a force-transmission between the traveling toothed belts 21*a*, 21*b* and the respective flat bar ends 14*a*, 14*b* is ensured by a belt tooth or teeth projecting into an opening provided in the flat bar ends 14*a*, 14*b*. When the grinding flat bar 14*n* is on the return travel section of the traveling flats assembly as shown in FIG. 3*a*, the grinding flat bar 14*n* lies on top of the toothed belts and may be simply lifted off. Thus, when grinding operation is desired, one of the regular clothed flat bars (such as 14*a* or 14*b*) is lifted off the belts 21*a*, 21*b* and a grinding flat bar 14*n* is placed on the belts in the place of the removed clothed flat bar.

In FIG. 3*b* the grinding element 17 is situated on the working portion (operational zone) of the traveling flats assembly 13, that is, on that side which is oriented towards the cylinder clothing 4*a*. On that side the underface of the grindstone 18 is in a grinding contact with the cylinder clothing 4*a*. The clothed flat bars 14 and the grinding element 17 travel with a speed of, for example, 191 mm/min while the circumferential speed of the carding cylinder 4 and thus the cylinder clothing 4*a* is, for example, 30 m/sec.

Figure 4A:
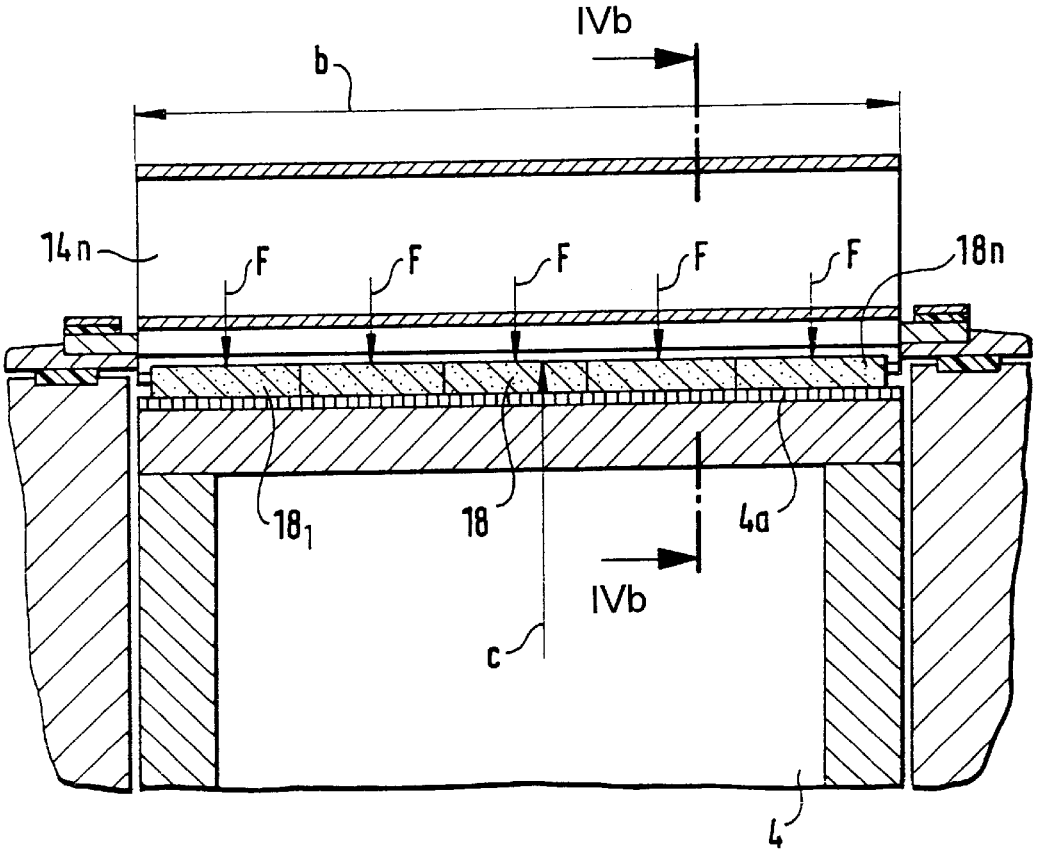
FIG. 4*a* is a sectional front elevational view of a grinding element mounted on a flat bar which is installed in the travelling flats assembly and is depicted during the grinding of the cylinder clothing.
Figure 4B:
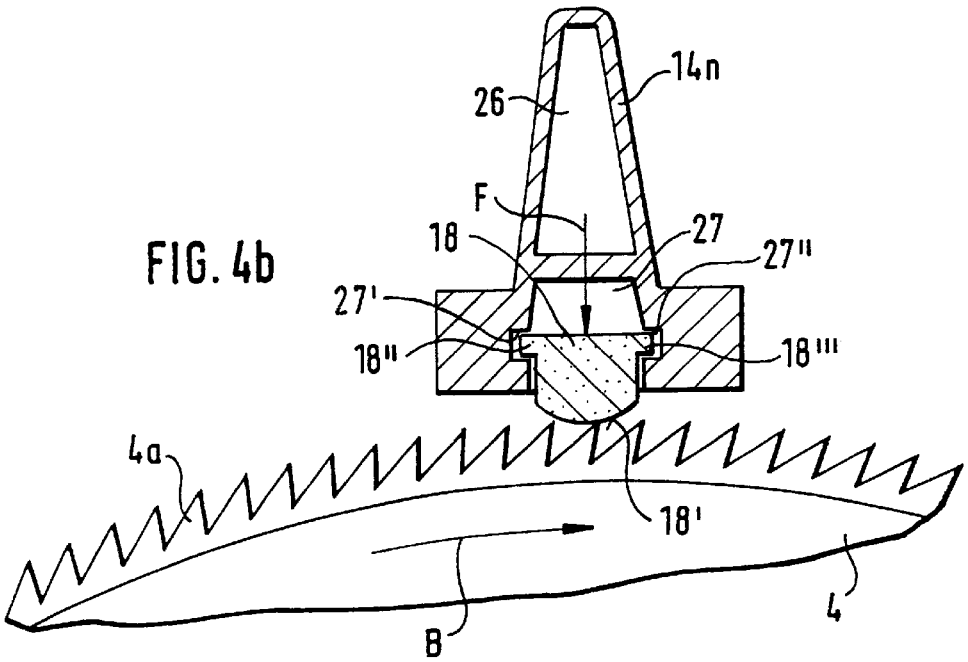
FIG. 4*b* is a sectional view taken along line IVb—IVb of FIG. 4*a*.

Turning to FIG. 4*a*, the grinding flat bar 14*n* which has a length b of, for example, 1,025 mm, extends over the width of the carding machine, that is, over the axial length of the carding cylinder 4. The radius c of the carding cylinder 4 may be, for example, 643 mm. The grinding flat bar 14*n* is, for example, of extruded aluminum and, as shown in FIG. 4*b*, has inner hollow spaces 26, 27. The grindstone 18 is accommodated in the space 27. As shown in FIG. 4*b*, the grindstone 18 has a convex grinding face 18' oriented towards the cylinder clothing 4*a*. At its end oriented away from the cylinder clothing 4*a* the grindstone 18 has two lateral projections 18" and 18'" which extend into lateral bays 27', 27" and by means of which the grindstone 18 is held captive in the space 27. This arrangement provides that the grindstone 18 is biased by its own weight, that is, by the gravity force F against the cylinder clothing 4*a*. By virtue of the vertical displaceability of the grindstone 18, the latter may adapt itself readily to non-uniform heights of the points of the cylinder clothing 4*a*. The grindstone 18 may also rotate about a vertical axis, as a result of which different regions of the rounded grinding surface 18' may, in a flexible manner, engage the points of the clothing 4*a*, whereby a more even wear of the grindstone 18 is obtained. As an alternative to the arrangement shown in FIGS. 4*a* and 4*b*, the biasing force that presses the grindstone 18 against the cylinder clothing 4*a* may be supplied by the tension of the belts 21*a*, 21*b*.

Figure 5:
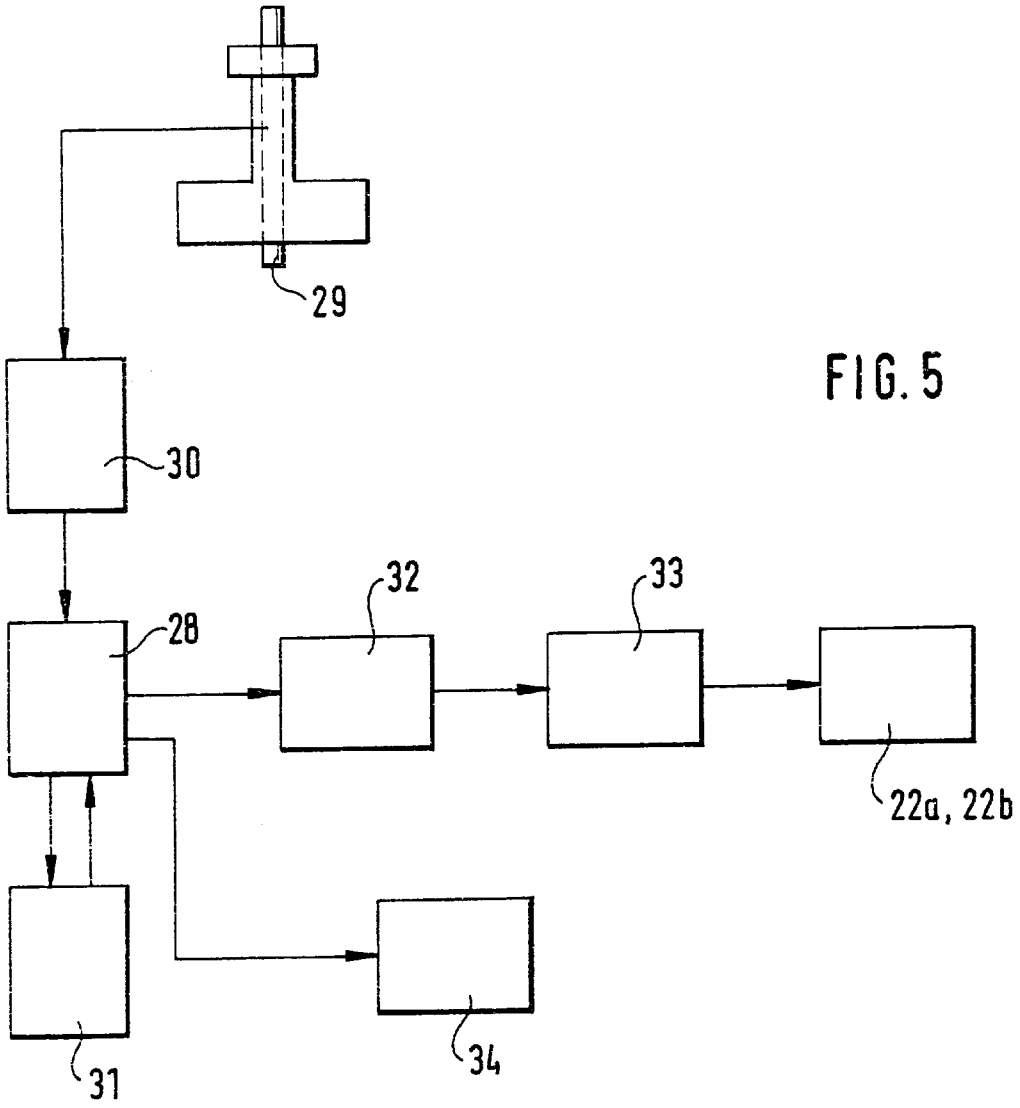
FIG. 5 is a block diagram of an electronic control and regulating device with a measuring and setting device for setting the distance between the flats clothings and the carding cylinder clothing.

FIG. 5 illustrates and electronic control and regulating device 28, for example, a microcomputer for the carding machine CM. A measuring member 29, for example, a FLAT CONTROL FCT model (manufactured by Trützschler GmbH & Co. KG) for detecting the distance a between the points of the flat bar clothings 21 and the points of the cylinder clothing 4*a* is connected to the device 28. As a result of the grinding, the distance a increases. The measuring member 29 is coupled with a measuring value emitter 30 which indicates the detected values and applies them to the card control device 28 which has a memory 31. The card control device 28 transmits signals to a switching element 32 which actuates a setting device 33 adjusting the flexible bends 22*a*, 22*b* in order to equalize the clearance a or to provide a new setting based on other operational conditions. At the same time, this information is applied to a card information system KIT 34 (manufactured by Trüitzschler GmbH & Co.) having a computer and display unit where the data of an entire carding group are monitored.

It will be understood that the above description of the present invention is susceptible to various modifications, changes and adaptations, and the same are intended to be comprehended within the meaning and range of equivalents of the appended claims.

What is claimed is:

1. A carding machine comprising (a) a main carding cylinder having a circumferential surface carrying a cylinder clothing thereon;

(b) a traveling flats assembly cooperating with said main carding cylinder and including (1) a plurality of clothed flat bars arranged in a series and being provided with a flat bar clothing; and (2) a flat drive for moving said clothed flat bars in an endless path having a working path portion along which the flat bar clothings cooperate with said cylinder clothing and a return path portion; and (c) a grinding assembly for sharpening said cylinder clothing; said grinding assembly including (1) a grinding flat bar adapted to be positioned in said series of clothed flat bars to be moved by said flat drive in unison with said clothed flat bars; and (2) a grinding element mounted on said grinding flat bar; said grinding element being in a contacting relationship with said cylinder clothing along said working path portion.

2. The carding machine as defined in claim 1, further comprising releasable means for releasably coupling said grinding flat bar to said flat drive for a rapid attachment of said grinding flat bar to and a rapid removal thereof from said flat drive while said grinding flat bar is positioned at a location along said return path portion.

3. The carding machine as defined in claim 1, wherein said flat drive includes an endless belt and said releasable means includes means for providing a driving engagement between said belt and said grinding flat bar.

4. The carding machine as defined in claim 3, wherein said grinding flat bar is loosely positioned on an upwardly oriented face of said belt along said return path portion.

5. The carding machine as defined in claim 1, further comprising pressing means for urging said grinding element into contact with said cylinder clothing.

6. The carding machine as defined in claim 5, further comprising means for vertically movably holding said grinding element in said grinding flat bar, whereby said grinding element is urged into contact with said cylinder clothing by the weight of said grinding element; said pressing means comprises said weight.

7. The carding machine as defined in claim 5, wherein said flat drive includes an endless belt coupled to said grinding flat bar and further wherein said pressing means includes said endless belt pressing said grinding flat bar towards said cylinder clothing.

8. The carding machine as defined in claim 1, wherein said main carding cylinder has an axis of rotation and further wherein said grinding element has a length extending parallel to said axis of rotation.

9. The carding machine as defined in claim 8, wherein said length substantially corresponds to the axial length of said main carding cylinder.

10. The carding machine as defined in claim 1, wherein said main carding cylinder has an axis of rotation and further wherein said grinding element has a length extending transversely to said axis of rotation.

11. The carding machine as defined in claim 1, further comprising (a) means for movably holding said grinding element in said grinding flat bar; and (b) a drive motor coupled to said grinding element for moving said grinding element toward and away from said cylinder clothing relative to said grinding flat bar.

12. The carding machine as defined in claim 11, further comprising a control device operatively connected to said drive motor.

* * * * *